United States Patent [19]

Elsbree, Jr. et al.

[11] Patent Number: 4,606,589

[45] Date of Patent: Aug. 19, 1986

[54] COMPLIANT PIN

[75] Inventors: Charles N. Elsbree, Jr., Cupertino; Hector A. Regner, Newport Beach, both of Calif.; Claude Rodriguez, Carlloton, Tex.; Anthony Ravlich, Huntington Beach, Calif.

[73] Assignee: H & V Services, Fountain Valley, Calif.

[21] Appl. No.: 570,065

[22] Filed: Jan. 12, 1984

[51] Int. Cl.[4] ..... H01R 4/24

[52] U.S. Cl. ..... 339/17 C; 339/221 R

[58] Field of Search ..... 539/17 C, 220 R, 221 R, 539/221 M

[56] References Cited

U.S. PATENT DOCUMENTS

| | | | |
|---|---|---|---|
| 3,783,433 | 1/1974 | Kurtz et al. | 339/17 C |
| 4,066,326 | 1/1978 | Lovendusky | 339/221 M |
| 4,186,982 | 2/1980 | Cobaugh et al. | 339/221 M |
| 4,274,699 | 6/1981 | Keim | 339/220 R |
| 4,286,837 | 9/1981 | Yasutake et al. | 339/221 R |

OTHER PUBLICATIONS

"Berg Compliant Press-Fit Pins", Data Sheet 7001/7010, Dec. 1982.

*Primary Examiner*—Gil Weidenfeld
*Assistant Examiner*—Gary F. Paumen
*Attorney, Agent, or Firm*—Townsend and Townsend

[57] ABSTRACT

A compliant pin for preferable insertion into a multilayer backpanel is disclosed. The pin includes a wire-wrap area, a pin stop, and a connector area. Between the connector area and the stop there is located the compliant area which forms the critical function of pin support and electrical connection. The compliant area includes first and second legs spreading out to define an eye from the pin stop adjacent the wire-wrap area of the pin. Similarly, the paired legs come together at a symmetrically defined eye adjacent the connector area. In between the eyes, along the compliant portions of the leg, are formed opposing offset wedges. The opposing offset wedges are defined by a stamping process which process does not deform the sheet of material out of which the pin is made from its original planar disposition. Looking at the pin in section, paired and offset wedges are formed at an approximate 45° angle to the plane of the material from which the pin is formed. These wedges are offset so that when the legs are urged towards one another the apexes of the wedges move to contact the surface of the opposing wedge. Upon such contact, a sliding interface occurs. Exteriorly of the wedge area the pin at each wedge is provided with a broad area of contact at the hole, preferably spaced apart shoulders. These shoulders bear upon the surface of the cylindrical apertures into which the pin is placed. In insertion, the compliant legs come in contact with the cylindrical holes. They are urged one towards the other until contact is made. Thereafter, the compliant legs are urged against another and form a sliding interface which interface for the first time functions to deform the pin members out of the plane of the material from which they were formed. A pin with adequate electrical connection to a large range of hole diameters with structural rigidity results.

11 Claims, 15 Drawing Figures

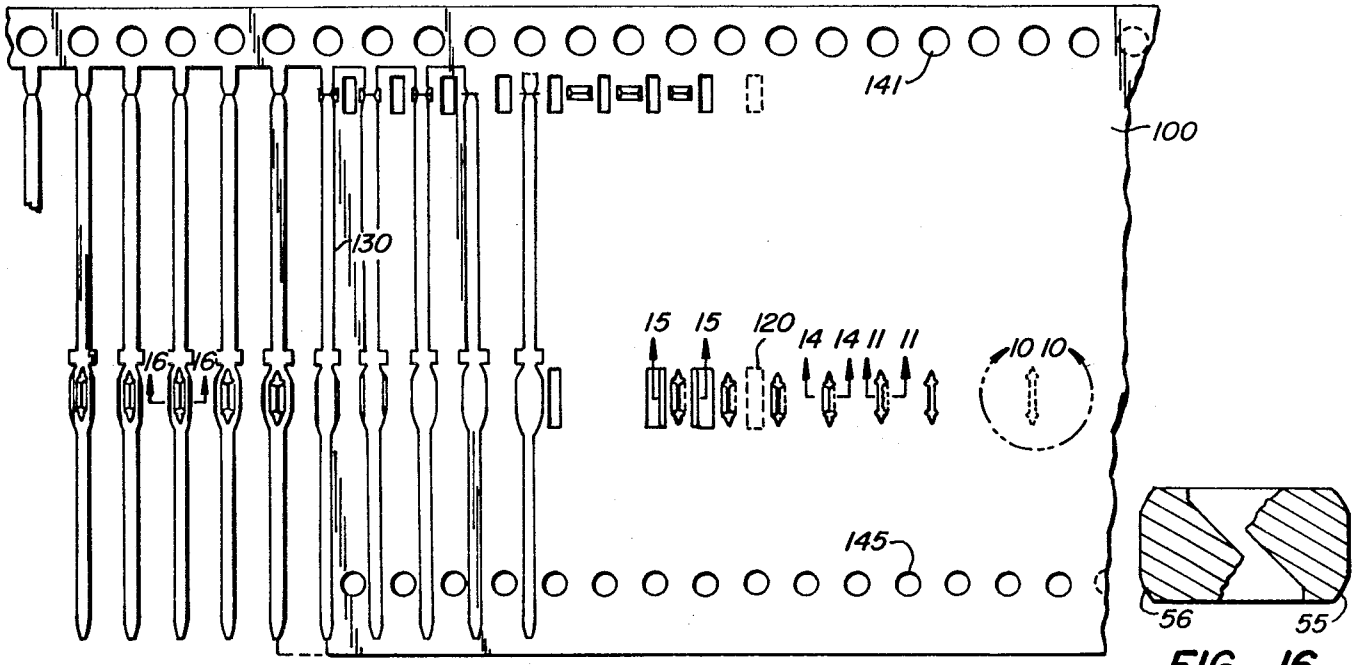
FIG._9.
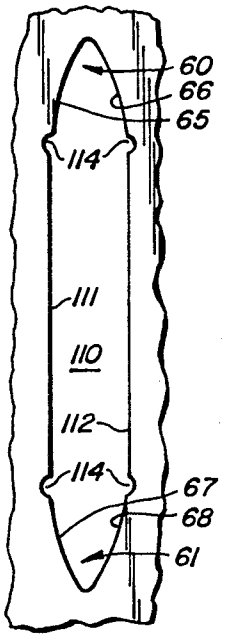
FIG._10.
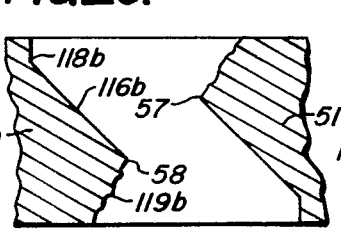
FIG._11.
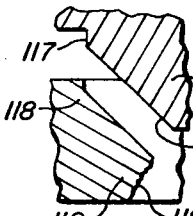
FIG._12.
FIG._14.
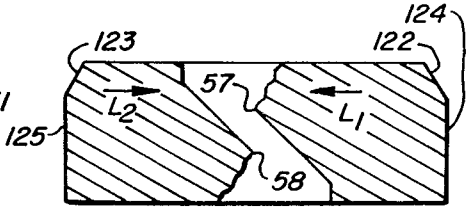
FIG._15.
FIG._16.

COMPLIANT PIN

BACKGROUND OF THE INVENTION

In the manufacture of printed circuit assemblies electrical pin contacts are inserted into multilayer boards called backpanels. It is desirable to retain the structural integrity of the board, while guaranteeing electrical communication between the pin and board.

The backpanel itself is in a sandwich construction of a layered matrix of conductive pathways between sandwiched layers of dielectric material. Electrical communication with the conductive pathways occurs by means of stamped and plated pins, which need a hole through the backpanel in which to make such contact.

Such pins also constitute support points for daughter boards and other similar electrical components. The pins hold these daughter boards, and also constitute electrical communication with them. In the modern digital environment, these electrical contacts must be uniform, and cannot have unacceptably variable resistances. The traditional method of manufacture works against and in opposition to these dual requirements of support and electrical communication.

A complete description of how a board has a pin mounted to it can be simply stated. A board is drilled out at precisely positioned points, so that some of the conductive pathways are pierced, while others are avoided. These drilled holes are then subjected to a plating process which leaves resident a plated cylinder.

The electrical connection between the conductive layer at the drilled interface and the material plated into the drilled hole must be carefully understood. This juncture is a very sensitive and delicate interface of electrical connection which must not be disturbed or interfered with. Movement of the plated cylindrical aperture, either by shearing or twisting, or moving the conductive layer out of its planar disposition can cause interference with the desired electrical characteristics of the pin. In short, this delicate electrical interface between plated cylindrical hole and conductive layer must be substantially undisturbed.

Pins are inserted in the holes in a forcefitted process. Because of the nature of the plating process, the resultant holes are not precisely sized, but have varying diameters.

Therefore a pin connector is needed that is both insertable in holes of slightly varying diameters and has the structural integrity required to support daughter boards as well as withstand the insertion force. In addition, it is desirable that the pin provide uniform electrical connections.

So-called "eye of the needle" compliant pins are known. These pins at all stages of deformation maintain a spatial separation between their respective compliant legs. Unfortunately, these compliant legs are subject to a kind of columnar collapse. This columnar collapse pulls the pins out of electrical contact with the plated hole into which they are inserted. This is highly undesirable.

When a pin separates from the sides of a plated cylindrical hole, the connection of the pin to the hole is no longer "gas tight". When the connection is no longer gas tight actual corrosion of the pin in the field has been known to occur. The back panel fails in the field and frequently has to be replaced. Since the back panel typically is the very foundation of the electrical equipment into which it is placed, such failures can be catastrophic.

Other compliant pins are known. Such pins typically have a solid pin member at each end and two legs joined at said ends, with a sliding interface between said legs.

We have found relative to the prior art pins that two major faults cause unsatisfactory connections. First, if the legs exhibit a cross-section which includes a sharp edge that contacts the aperture, the pins ride into and deform the cylindrical holes into which they are placed. This deformation alters and changes the desired conformity of the electrical connection. It can be seen by photographic analysis that the sides of the cylindrical holes are also destroyed.

In addition, we find that such pins undergo twisting, either of the entire pin or portions thereof, during the insertion process. This defect causes the pin to make non-uniform electrical contact. It also tends to destroy the cylinder itself, at the points where it makes the required electrical connection.

Nonuniform contact between the plated hole and the pin or deformation of the hole (especially deformation which destroys the planar disposition of the electrical conductive layer) charges the impedance of the electrical connection. This change in impedance may or may not relate to the integrity of the electrical connection; it nonetheless destroys the utility of the circuit.

Deformation of the cylinder, with the resultant whole or partial destruction of the required electrical connection, may necessitate rejection of the entire backpanel, since it is often difficult if not impossible to determine where the fault exists in the circuit.

Some prior art pins have their respective legs separated one from another by "lancing". In such a process, the metal of one leg is abruptly sheared from the metal of an adjoining leg. In actual photographs we have taken it can be seen and we have discovered that the interfaces produced by such shearing are rough or at least microscopically serrated. These rough edges are believed to produce adverse compliant spring forces when the pins are inserted. As will be understood, we go to the expedient of working and polishing by stamping to avoid this irregular interface produced by shear.

We also note that certain prior art pins have their respective legs totally offset and bent out of the plane of the material from which they were originally formed. Such pins, in order to compliantly yield, must restraighten the bent legs. Resistance increases as the respective legs approach their original coplanar disposition. Such pins have an increasing tendency to deform and destroy the cylindrical apertures into which they are placed.

The reader will understand that the discovery of the problems of the prior art as well as their solution can constitute invention. Consequently, we herein state the difficulties with the prior art as we have come to know them after extensive experimentation. These difficulties may at best be divided into defects which are inherent to the pin itself, as well as defects that the pin imparts to the board which it transverses.

With respect to the pin, where it requires excessive force being inserted into the hole, difficulties occur. Buckling as well as hole destruction are some of the effects.

Further, the pin, when in the hole, can have a low retention characteristic. With such a characteristic not only is the pin easily removed, but the electrical connection can fail.

Likewise, the pin can be subject to cracking, this cracking especially occurring where compliant legs depart from the main body of the pin. Such departure interferes with the structural integrity of the pin and renders nonuniform the desired electrical connection.

Likewise, the pin can be bent either during the insertion process itself or as the pin protrudes from the hole. Where a matrix of such pins are required for the connection of components, a pin out of align prevents the structural attachment.

Further, it is known that pins twist during insertion. This twisting force can be a source of loss of the desired electrical connection. Further, the pin itself can be canted or cocked as it protrudes from the board. This canting or cocking of the pin prevents the desired connection of electrical components.

Likewise, where the legs of the pin are separated from the sidewalls of the plated hole, a non-gas tight connection occurs. This non-gas tight connection can be the subject of corrosion, which corrosion eventually destroys the electrical connection of the pin and the utility of the backpanel of which it is a part.

Improper pin design also causes difficulty with the plated through hole. Specifically, the pin in passing can gouge and create plating voids. These voids interfere with the uniform impedance required for modern digital electrical connection.

Most crucially, if the plated cylinder is destroyed at or near an electrical connection to one of the conductive layers of the board, critical damage can be done.

Further, tight pin fitting causes slivers to be dislodged and fall, not only across the plated hole, but elsewhere throughout the backpanel assembly. There results slivers which can lodge and cause undesired short circuits, which circuits are extremely difficult to restore to their intended dielectric condition.

Improperly fitted pins cause change of electrical impedance values in the board. While the change of these electrical impedance values is difficult to quantify, it can come from changed resistance, electromagnetic forces extending between adjacent conductive layers, disturbed portions of the plated hole and many other factors which in the microscopic environment of the board are difficult to identify.

It should be realized that when groups of pins with improper fit are inserted, they can together cause warping and bowing of the backpanel board. Since the backpanel board frequently provides the very foundation of the electrical component of which it is a part, such warping and bowing is unacceptable.

Likewise, the pins must be capable of some working as they form the desired interconnection with the board. Lack of this working can cause delamination of the board in the field, again resulting in board failure.

We have found that an inordinate amount of attention has been devoted to the function of the pins themselves; we have found that their interaction with the board is just as important.

We have found after two years of experimentation that pins forced in conductive holes and backpanels are very empirical and arbitrary in their performance. We therefore disclose in the following specification a specific design developed by us which we have found has a low incidence of failure of electrical connections and provides necessary flexibility for insertion into holes of a wide range of diameters, making for all this range the required electrical connection.

SUMMARY OF THE INVENTION

A compliant pin for preferable insertion into a multilayer backpanel is disclosed. The pin includes a wire-wrap area, a pin stop, and a connector area. Between the connector area and the stop there is located the compliant area which forms the critical function of pin support and electrical connection. The compliant area includes first and second legs spreading out to define an eye from the pin stop adjacent the wire-wrap area of the pin. Similarly, the paired legs comes together at a symmetrically defined eye adjacent the connector area. In between the eyes, along the compliant portions of the leg, are formed opposing offset wedges. The opposing offset wedges are defined by a stamping process which process does not deform the sheet of material out of which the pin is made from its original planar disposition.

Looking at the pin in section, paired and offset wedges are formed at an approximate 45° angle to the plane of the material from which the pin is formed. These wedges are offset so that when the legs are urged towards one another the apexes of the wedges move to contact the surface of the opposing wedge. Upon such contact, a sliding interface occurs.

Exteriorly of the wedge area the pin at each wedge is provided with a broad area of contact at the hole, preferably spaced apart shoulders. These shoulders bear upon the surface of the cylindrical apertures into which the pin is placed. In insertion, the compliant legs come in contact with the cylindrical holes. They are urged one towards the other until contact is made. Thereafter, the compliant legs are urged against another and form a sliding interface which interface for the first time functions to deform the pin members out of the plane of the material from which they were formed. A pin with adequate electrical connection to a large range of hole diameters with structural rigidity results.

DESCRIPTION OF THE FIGURES

FIG. 9 is a plan view of a strip illustrating in sequence the individual stampings required for the manufacture of the pin and emphasizing the linearity of all parts of the pin during manufacture;

FIG. 10 is a magnified view of area 10 on FIG. 9;

FIG. 11 is a side elevation section taken along lines 11—11 of FIG. 9;

FIG. 12 is a schematic illustrating the position of a single knife in forming the wedges utilized with this invention;

FIG. 13 is a side elevation section taken along line 13—13 of FIG. 9 illustrating the plate after both wedges have been formed;

FIG. 14 illustrates the paired wedges after recentering has occurred along the section 14—14 of FIG. 9; and FIG. 15 illustrates the section along lines 15—15 of FIG. 9 illustrating the finalized compliant section of the pin herein disclosed.

DESCRIPTION OF THE PREFERRED EMBODIMENT

Figure 1:
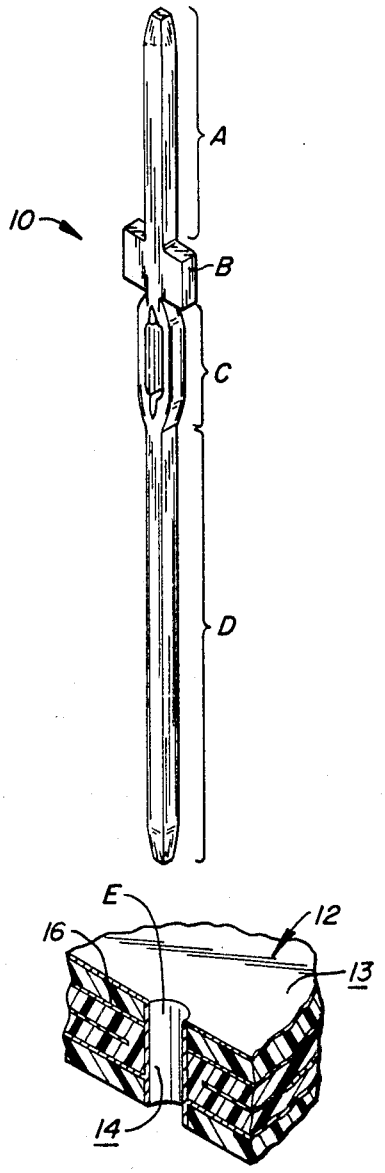
FIG. 1 is a perspective and exploded view of the compliant pin overlying a aperture in a multi-layer circuit board.

Referring to FIG. 1, the compliant pin 10 is shown overlying the circuit board or backpanel 12. The pin includes a wire-wrap area D, a stop B, a compliant section C, and a connector area A. In operation, the pin is inserted by force into plated cylindrical aperture E of the backpanel; the interior of which is a continuous strip of conductive metallic plated material 14. This material 14 and its contact with the conductive layers 16 within the circuit board is the electrical contact that must not be interfered with by the forceable insertion of the pin.

We have illustrated a simple form of pin having a wire wrap area D, stop B, compliant section C and connector area A, all in a stated serial order from end to end of the pin. The reader will understand that pins of many designs are found and commonly know which reverse and otherwise modify these design orders. For example, pins are known which have springs and clips attached to them; likewise, the term "connector arm" can be used to refer to either end of the pin.

Figure 2:
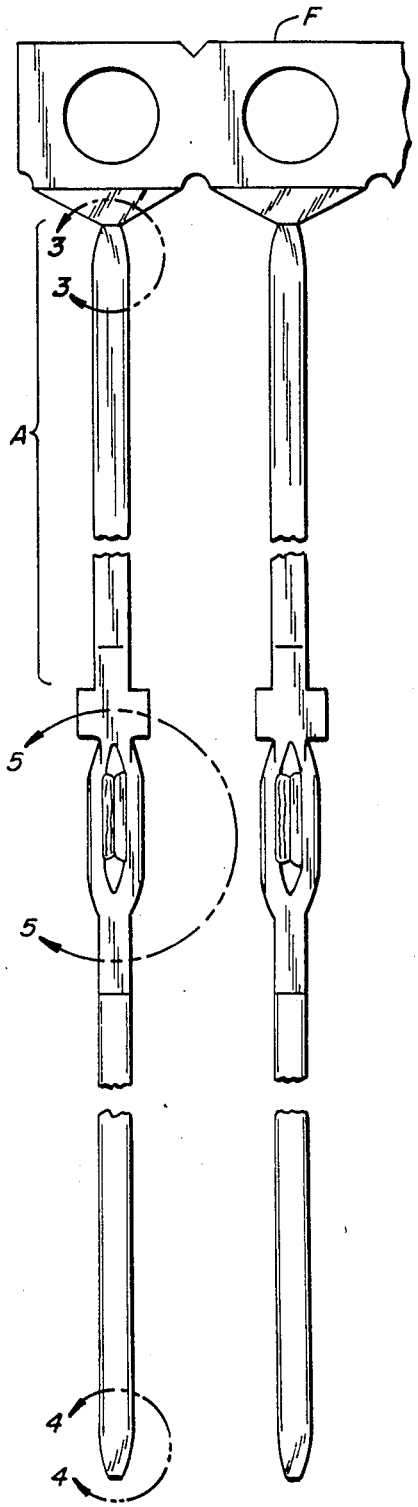
FIG. 2 is a view of two side-by-side pins constructed in accordance with this invention still attached to the carrier strip which provides for appropriate side-by-side spacing during stamping of the pin.

Referring to FIG. 2, compliant pins after stamping are illustrated. They are connected by their wire-wrap portions D to a carrier strip F. The carrier strip F functions at least in part to space pins during their process of manufacture.

Figure 3:
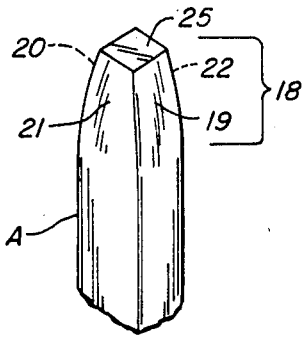
FIG. 3 is a detail of the end of the pin immediately adjacent the carrier strip.

Referring to FIG. 3, a detail of the pin adjacent the carrier strip F is illustrated. Wire-wrap post D terminates in a tapered section 18. Tapered section 18 includes cornered radii in four sections 19, 20, 21 and 22. Area 25 forms the break-off section from the carrier strip F and is typically broken when the pin is inserted.

Figure 4:
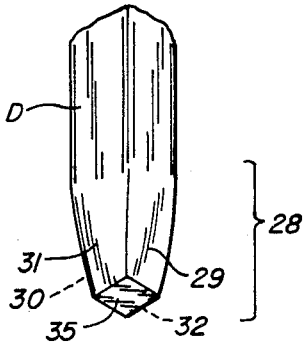
FIG. 4 is a detail of the end of the pin remote from the illustrated carrier strip.

Referring to FIG. 4, a detail of the pin at the end of the connector area A is illustrated. A tapered section of the pin 28 has cornered radii 29, 30, 31 and 32. A blunted area 35 removed from the opposite carrier strip (not shown) completes the pin detail.

The reader will understand that the length of the wire-wrap area D and the connector area A as well as the compliant area C may be changed to suit the needed application. Dependent upon the length of the components involved, these dimensions may be altered.

Figure 5:
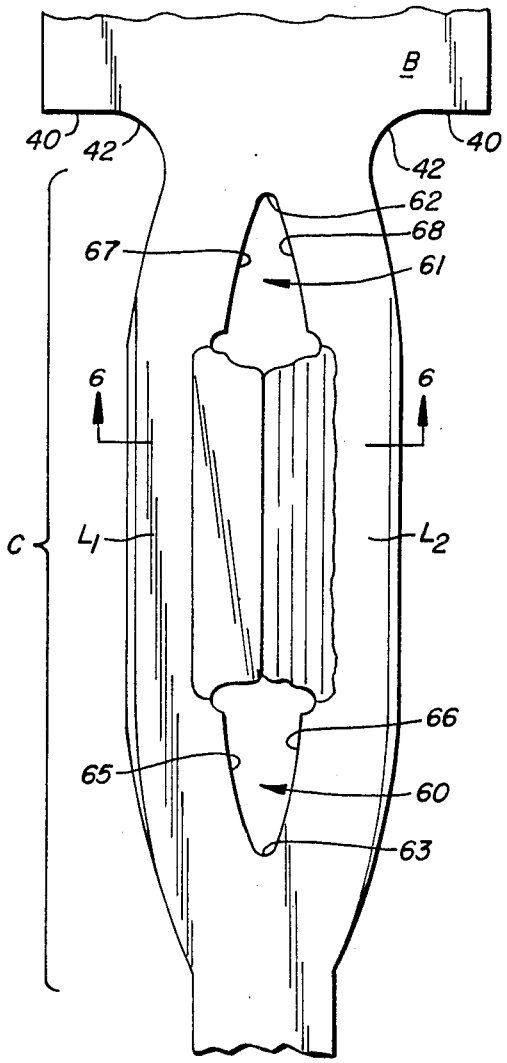
FIG. 5 is a plan view in the plane of the pin illustrating the opposing legs and wedges of the compliant pin before insertion.

Referring to FIGS. 1 and 5, the stop area B may now be set forth. Stop area B functions to come against the surface 13 of the backpanel 12.

Stop B extends outwardly and beyond the section of the compliant pin. It registers at lower surface 40 onto surface 13 of the backpanel. This registration causes precise penetration of the compliant section C with respect to the hole. See FIG. 7.

It will be noted that shoulder 40, as it becomes and joins to each of the legs L1, L2 of the compliant section C, has a rounded and relieved section 42. Section 42 is so designed to prevent cracks and resultant structural failure and electrical interruption between either of the legs L1, L2 and the remaining portions of the pin.

Figure 6:
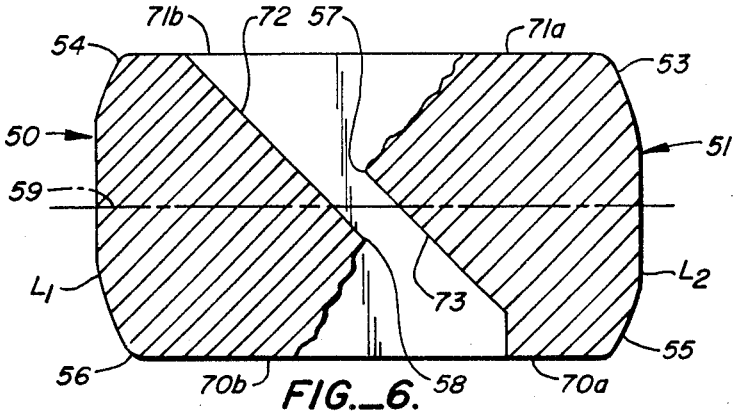
FIG. 6 is a side elevation section taken along lines 6—6 of FIG. 5 illustrating the pin and its compliant legs before insertion.

Compliant section C can be easily understood. It includes opposed legs L1, L2. Each one of these legs has offset wedges. These wedges are best illustrated in FIG. 6 and are denoted as wedges 50, 51. Describing one wedge relative to the horizontal centerline 59 can be instructive.

It will be seen that the overall section of the pin flares in above and below the compliant section of the pin in a "bullet-like" configuration. This portion of the compliant pin is therefore sometimes referred to as the "bullet section" of the pin.

The wedge 51 includes a paired cylinder-bearing shoulders 53, 55. These shoulders form the points of contact between the plated cylindrical hole and the conductive and typically plated pin. An offset apex 57 is formed in the wedge. Taking a horizontal centerline 59 through the pin, it will be noted that the apex 57 of the wedge is above the centerline with respect to leg 51. Wedge 50 may be similarly described and is complementary in shape. Specifically, it includes shoulders 54, 56 for bearing against the cylindrical walls. An apex 58 is present on the offset wedge 50. The apex 58 of offset wedge 50 is below the horizontal centerline 59.

We have herein illustrated shoulders 53, 55 on wedge 51 and shoulders 54, 56 on wedge 50 as the contact portions for urging the offset wedges one towards another. The reader should understand that other broad points of support between the plated cylinder 14 and the base of the wedges 50, 51 will work as well. For example if the base of the wedge has a radius of curvature the same as or slightly exceeding the inside diameter of plated cylinder 14, the pin will work as well. What must occur is a broad base of support for each opposing wedge along spaced apart longitudinal areas of contact extending substantially parallel to the apex of the wedge.

Regarding these points of wedge support, single points of support are to be avoided. Moreover, sharp ridges which cut into and otherwise destroy the plated cylinder 14 are likewise to be avoided.

Returning to FIG. 5, it can be seen that the respective legs L1 and L2 have wedge portions that extend only a portion of the total length of the compliant section C. These wedge portions are on either side of the respective defined eyes 60, 61.

Eyes 60, 61 include a rounded and relieved joinder 62, 63 with two complementary and rounded arches 65, 66 and 67, 68. Arches 65, 66 and 67, 68 enable compliant bending of legs L1, L2 without any sliding wedge interface occurring at these junctures. Suitable relieving of the pin junctures at eyes 60, 61 are provided to prevent metal failure as by cracking.

Important departures of this pin from the pins of the prior art can be noted at this point. First, and by the view of FIG. 6, the reader will understand that the pin as originally fabricated does not interrupt the plane of metal out of which the pin was originally stamped. That is to say, referring to FIG. 6, lower surfaces 70A and 70B lie in the same plane. Similarly and referring to FIG. 6, upper surfaces 71A and 71B also lie in the same plane.

In prior art embodiments, the stamping process occurs so as to move the equivalent of surfaces 70A and 70B out of the same plane.

We have found that such offset of the legs has several undesirable effects. This offset causes the pin to have a twist relative to the hole in which it is inserted. Deformation of the plated portions of the hole occurs. These deformations destroy the interface between the cylinder 14 and the electrical conducting substrates 16. When it is remembered that in multilayered boards one such interruption in hundreds of inserted pins in a single board can cause the entire board to be discarded, the criticality of this feature cannot be overemphasized. Secondly, the reader will note that with respect to planes 70A, 70B, 71A, 71B, a wedge surface 72 on wedge 50 and wedge surface 73 on wedge 51 are formed. These wedge surfaces are disposed at an angle in the range of 45° with respect to the planes 70A, 70B, and 71A, 71B.

The function of these wedge surfaces can now be described. We will first describe the function of these offset wedges and surfaces 72, 73 with respect to FIG. 5 before insertion of the pin in the hole. Thereafter, we will refer to FIGS. 7 and 8, actual photographic reproductions of the pin in the hole. These will illustrate the relative movement and function of the compliant sections of the pin in the hole.

The reader will understand that the pins are placed in the board with a driving or "push in" force. Once driven in the hole, they resist being dislodged with a "pull out" force. A main goal of the present design is to minimize the "push in" force so as to avoid hole destruction, pin destruction or both. At the same time, the "pull out" force must be sufficient to preserve the desired electrical connection and at the same time provide component support.

Referring to FIG. 6, it will be seen that when the offset wedges 50, 51 move one towards another, this will be done at approximately four points of urging. Two points of urging 54, 56 will act and move offset wedge 50 at apex 58 towards surface 73 of wedge 51. Similarly, shoulders 53, 55 on offset wedge 51 will move apex 57 towards surface 72. Movement of the respective legs L1, L2 towards one another will occur. This movement will continue until the complementary and sliding wedge surfaces 72, 73 come in contact, one with another.

It will be noted that in such movement each wedge is urged into contact with the opposing offset wedge at two spaced apart points. These points are shoulders 54, 56 on wedge 50. Similarly, they are shoulders 53, 55 on wedge 51.

As previously mentioned, a wedge angle on the order of 45° is desirable. If the angle is too steep (approaching the perpendicular with plane 70A, 70B), the wedges move against one another with difficulty, and the shoulders tend to destroy the aperture walls. On the other hand, if the wedge angle is too shallow, the wedges move too freely past one another, and poor electrical connection with the aperture results. Accordingly, we have found that a wedge angle between 30°-60° gives the best results of structural rigidity and electrical contact.

We contemplate variability of the wedge angle of the pin to meet the need of the structural properties of the plated cylindrical hole 14. For example, where cylindrical hole 14 has thin walls and/or multiple delicate layers, a large angle—up to 60° may be used. Conversely, where the walls are thick and/or the board has thin or few multiple layers, shallow wedge angles up to 30° will be used.

In addition to varying the angle of the opposed wedges, we also vary their length. In the preferred embodiment herein shown, we have the wedges constitute three fifths (3/5ths) of the total eye 60 to eye 61 compliant section of the pin. That is, measuring from eye portion 62 on eye 61 to eye portion 63 on eye 60, the wedges constitute 3/5ths of the overall length. This ratio of the length of the wedge portion relative to the length of the eye to eye portion can be varied.

Certain prior compliant pins do not have such broad-based points of bearing for the urged movement of their legs one towards another. They instead urge each wedge at an effectively single point of bearing on the conductive wall 14 of the board 12. This causes needless deformation and destruction of the hole walls as well as a twisting action of the pin as it interacts with the hole during insertion.

Figure 7:
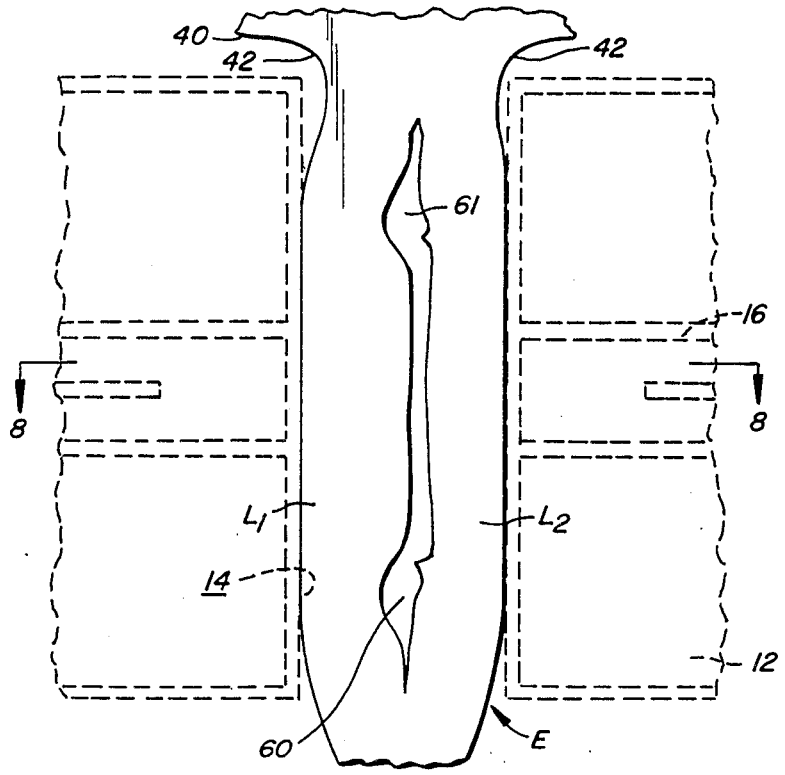
FIG. 7 is a side elevation longitudinal section of the compliant portion of the pin, similar to FIG. 5., illustrating the pin as actually inserted, it being noted that FIGS. 7 and 8 are pen and ink drawings of actual photographic reproductions of th interaction between the pin and hole.
Figure 8:
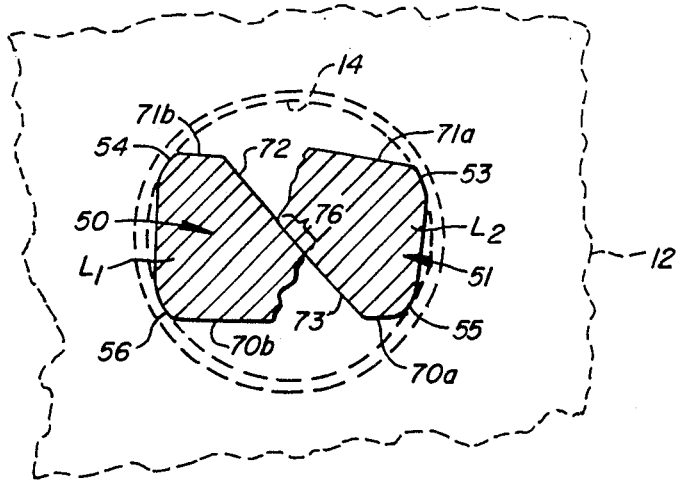
FIG. 8 is a side elevation lateral section, similar to FIG. 6, showing the pin after insertion and therefore illustrating the cylindrical aperture into which the pin is inserted.

Referring to FIG. 7, a side elevation longitudinal section of the compliant portion of the pin is shown, similar to FIG. 5, but after the pin has been inserted into the aperture. FIGS. 7 and 8 are pen and ink drawings of actual photographs of pins as inserted into an aperture.

Referring to FIG. 8, a cross-section similar to FIG. 6 is illustrated, this section being taken of the pin medially of the longitudinal section of the pin of FIG. 7 along lines 8—8. Compliant legs L1 and L2 are illustrated with their respective surfaces 73, 72 coming in contact along an area of common sliding interaction 76. It can be seen with respect to the compliant legs L1, L2 that it is only after insertion that the surfaces 70A, 70B are no longer coplanar. Similarly, the surfaces 71A, 71B are likewise no longer coplanar. Moreover, it will be seen that shoulders 54, 56 urge offset wedge 50 and shoulders 53, 55 urge offset wedge 51 into contact one with another. It is preferred that the shoulders contact the edges of the cylinder. In practice we find that at least one wedge has two bearing surfaces, while from time to time one of the shoulder surfaces may be spatially separated from the cylinder.

Referring to FIG. 8, we have chosen to show the usual and preferred condition of contact between the opposing wedge surfaces 72 of wedge 50 and 73 of wedge 51. The reader should understand that the pin herein is carefully dimensioned to accommodate a large number of hole sizes. The pin compliantly yields like a prior art "eye of the needle" pin to a point where the wedge surfaces 72, 73 come in contact. It is to be noted that such contact is not necessary to provide the requisite holding forces; where the hole aperture through lack of plating is relatively large, some contact may not occur.

It will be noted that the compliant legs do not move so far as to columnarly collapse under the push force required for pin insertion. When they have moved a sufficient distance where with the conventional "eye of the needle" pin a columnar collapse with a non-gas tight bonding would occur, the respective wedge surfaces come into contact. These wedge surfaces 72, 73 prevent the columnar collapse. Instead, the compliant section C is held in firm and electrically communicative contact with the side walls of the aperture.

While some movement of one compliant leg with respect to the other compliant leg to interrupt the plane 70A, 70B and 71A, 71B has occurred, the reader will understand that that interruption is essentially minute. In the formation of the pin as well as its insertion in the hole, the legs essentially remain coplanar one with another, with elastic movement only of the respective opposing wedges occurring to a slight degree once insertion within the hole has occurred.

Much has been made herein of the initial insertion of compliant pins in the board. It will be understood that frequently such pins must be inserted and replaced. It is a specific advantage of my pin over the prior art that such insertion and replacement may occur, usually without loss of the electrical and structural properties of the pin. Naturally, when this can occur, an entire back-panel assembly can be saved.

Likewise, the pin finds preferred insertion in and to multilayered boards. It will be understood that the pin may as well be used in boards with single conductive layers or even with just two conductive layers, one layer being on each side of a board.

As compared to prior art processes of manufacture, we are careful to make sure that the opposing wedges 50, 51 are made from substantially undisturbed planar sections taken from the sheet material from which the pin is originally formed. This being the case, we set forth in FIG. 9 the sequence of manufacture of the disclosed pin.

The reader will understand that the sequence set forth shows the metal worked in the discrete working steps utilized. Key steps common to the stamping art as known to skilled tool and die makers are set forth. We do not burden the reader with the actual stamping die constructions; that portion of the invention herein is believed to be of ordinary skill.

The invention is fabricated from a strip 100 which typically progresses from the right to the left through a stamping station. Broadly, a key is first configured in the area 10. Thereafter and at section 11—11, a first knife edge is formed. At section 14—14 a second knife edge is formed. At station 15—15 the knives' edges are given the proper position relative to one another. Finally, and at section 16—16, the pin is cut and broached or shaped at remaining side edge corners to leave a substantially complete pin. A description of the forming process in detail follows.

Referring to FIGS. 9 and 10, a hole 110 is punched interiorly of the metallic member. Paired straight edges 111 and 112 are made with the respective key holes 60, 61 formed on either end thereof. Suitable relieving of stress points is provided by punched holes 114 at the joinder between the straight edges 111, 112 and the respective arcuate openings 65, 66 in key hole 60, and 67, 68 in key hole 61.

Referring to FIG. 12, a die, which is only schematically illustrated at 115, works downwardly onto edge 112. The working surface 116 of the die polished to a finish of approximately 4 microns effects a polished stamping of edge 112. Natural malleability of the edge causes the off center wedge to be formed. A vertical offset 117 causes a corresponding and female offset 118 in the surface. Non-worked surface collapse forms a rough and irregular area 119 in the wedge surface. Referring to the enlarged view of FIG. 11, the polished and work surface 116A, complementary to the surface 116 can be seen. The non-working surface 119 with its collapsed surface is illustrated. It can be seen that a first off center wedge 51 is formed.

The reader will realize that at this time only one wedge is formed. Referring to FIG. 13, a complementary wedge is formed. Portions of the wedge have been given similar numbering, this numbering all being denoted by the letter B. It will be understood that the working die illustrated in FIG. 12 is merely inverted and the process of manufacture precisely similar.

Referring to FIG. 13, the reader will see that the respective apexes of the wedges 57 of wedge 51 and 58 of wedge 50 are spread apart. Referring to FIG. 9, the overall cutting and sizing of the pin as well as the bringing of the apexes together can now be set forth. After the offset wedges are formed, and at a time before any of the outline of the pin is formed, relieving windows 120 are cut in the passing sheet. These relieving windows allow the pin when detailed around the blank to be shaved instead of cut enmass. This shaving prevents the entirety of the pin from rolling and following the cutting.

The reader will understand that this windowing and prevention of rolling of the edges of the pin at or near what is to be the compliant legs L1, L2 is an important part of our preserving of the overall linearity of the compliant legs. With the preservation, we preserve undisturbed the elastic property of the metal.

After windows 120 are cut, the paired and opposed knife edges are repositioned towards each other as shown in the detail of FIG. 14.

Specifically, edges 122, 123 are coined at the same time the outside shoulder profile 124, 125 of the compliant legs L1, L2 are formed. This shouldering process moves the compliant legs to and towards each other. There results are repositioning of the apexes 57, 58 to an overall section of overlap.

The reader will understand that there is thus formed the wedges illustrated; remaining portions of the pin are formed by conventional die stamping techniques which will herein only briefly be discussed.

The pin is then blanked along profiles 130. During such blanking and in the vicinity of the now formed compliant legs, a pressure pad is placed on the compliant legs L1, L2 while their edges are shaved to the bullet-like profile. Preservation of the coplanar wedges is preserved.

We have emphasized and it is required that all the shoulders be essentially rounded. At the section 15—15 a broaching station is utilized to form shoulders 55, 56. This mechanism is in the order of a stamp actuated shaper which effectively chamfers the edges. It can be seen in FIG. 15 that the desired cross section of the wedges is therefore fully imparted.

We do not bother to discuss the conventional die shaping of the ends of the pin. Such die shaping is old, known, and requires many variants—each variant being configured for the particular shape of the pin utilized in the construction.

Likewise, it is useful to have spaced apart rows of apertures 141, 145 for the spacing and positive feed. This spacing and positive feed is ordinary in the art and will not be set forth further herein.

We have illustrated the compliant pins omitting the conventionally made stamping die. Such a die has approximately twelve stations, which stations are obvious to those having ordinary skill in the die stamping arts. Over the prior art, it is the formation of the opposing wedges as well as the windowing around the compliant legs which preserves the metal in a coplanar state which constitutes some of the major advances of our pin over the prior art.

What is claimed as invention is:

1. A compliant pin for insertion into a conductive aperture extending between the upper and lower surfaces of a backpanel of the type including one or more conductive layers preferably sandwiched between non-conductive layers, said pin comprising:

a connector portion for placement through and protrusion from one end of said aperture in said backpanel;

a compliant portion adjacent said connector portion, said compliant portion being substantially coextensive with said aperture;

a stop portion adjacent said compliant portion, said stop for registry to the surface of said backpanel to limit the penetration of said pin at said compliant portion;

said compliant portion having first and second compliant legs separated at a first defined eye adjacent said stop portion and joined together at a second defined eye adjacent said connector portion, said first and second compliant legs each defining a wedge including a longitudinal apex disposed on the inside of said legs and disposed towards the center of said pin and a pair of longitudinal shoulders for contact with said aperture disposed on the outside of said legs;

said defined eyes including an absence of material between said wedge and said connector and stop portions before insertion of said pin to permit compliant movement of said compliant legs from an expanded disposition when said pin is exterior of said conductive aperture to a contracted position with said pin is positioned in said conductive aperture, whereby each leg is free to compliantly move towards and away from said other leg to maintain said legs in said conductive aperture; and the wedge apex of said first leg being offset with respect to the wedge apex of said second leg to cause said wedges when urged together during insertion into said conductive aperture to move towards one another along a sliding interface, said wedges having been separated from one another by a predetermined distance before insertion of said pin into said conductive aperture, and said pin has an essentially rectangular cross-section normal to the longitudinal axis of said pin, and said sliding interface is inclined relative to the major axis of said rectangular cross-section.

2. The compliant pin of claim 1 and wherein said sliding interface comprises a flat surface on each of said legs, and said flat surfaces are worked, polished, and confront one another.

3. The invention of claim 1 and wherein said stop portion has protruding therefrom a wire wrap terminal.

4. The invention of claim 1 and wherein said flat surfaces are inclined in the range of 30° to 60° with respect to center said major axis of said rectangular cross-section.

5. The compliant pin of claim 4 and wherein said flat surfaces are inclined at an angle of 45°.

6. A compliant pin and backpanel combination comprising:

a circuit board backpanel assembly having at least one conductive aperture therein;

a compliant pin in said aperture, said compliant pin including;

a connector portion protruding from one end of said aperture in said backpanel;

a compliant portion adjacent said connector portion, said compliant portion being substantially coextensive with said aperture;

a stop portion adjacent said compliant portion, said stop for registry to the surface of said backpanel to limit the penetration of said pin at said compliant portion;

said compliant portion having first and second compliant legs separated at a first defined eye adjacent said stop portion and joined together at a second defined eye adjacent said connector portion, said first and second compliant legs each defining a wedge including a flat longitudinal ramp carried on the inside of each of said legs and disposed towardes the center of said pin and a pair of longitudinal shoulders for contact with said aperture disposed on the outside of said legs;

each said defined eye including an absence of material between said wedges and said connector and stop portions before insertion of said pin to permit compliant movement of said compliant legs from an expanded disposition when said pin is exterior of said conductive aperture to a contracted position when said pin is positioned in said conductive aperture, whereby each leg is free to compliantly move towards and away from said other leg to maintain said legs in said conductive aperture;

said first compliant leg and said second compliant leg contacting said aperture with at least three of said longitudinal shoulders; and said flat ramps on said first and second compliant legs are in confronting relationship with each other to cause said wedges when urged together during insertion into said conductive aperture to move towards one another in sliding engagement along said flat ramps, said wedges having been separated from one another by a predetermined distance before insertion of said pin into said conductive aperture, and said pin has an essentially rectangular cross-section normal to the longitudinal axis of said pin and said flat ramps are inclined relative to the major axis of said rectangular cross-section.

7. The compliant pin and backpanel combination of claim 6 and wherein said stop supports a post protruding therefrom.

8. A compliant conductive pin for insertion into a conductive aperture, said pin having a pair of legs separated from one another to compliantly yield and tightly engage the peripheral surface of a plated cylindrical aperture into which said pin is inserted, said legs being joined at one end to a stop and at the opposite end to a post to define therebetween a compliant section, the improvement in said compliant section comprising:

a defined eye adjacent said stop, a defined eye adjacent said post, said legs extending between said eyes to define said compliant section, each said defined eye including an absence of material between its respective said stop or said post and said wedges before insertion of said pin to permit compliant movement of said compliant legs from an expanded disposition when said pin is exterior of said conductive aperture to a contracted position when said pin is positioned in said conductive aperture, whereby each leg is free to compliantly move towards and away from said other leg to maintain said legs in said conductive aperture;

each of said legs comprising a wedge having a longitudinal apex, said apex being offset, each wedge having the apex of said wedge overlying a flat worked surface of the opposing wedge;

said pin has an essentially rectangular cross-section normal to longitudinal axis of said pin, and said flat worked surfaces are inclined relative to the major axis of said rectangular cross-section;

further including paired longitudinal shoulders on each of said legs for contacting the peripheral surfaces of said aperture; and said legs being compliantly biasable to move in confronting relation along said flat worked surfaces towards and away from each other to permit said leg shoulders to come into retaining contact with said conductive aperture.

9. The invention of claim 8 and wherein said wedges are offset with respect to the plane of material from which they are formed in the range of 30° to 60°.

10. The invention of claim 9 and wherein said wedges are biasable into contact one with another upon insertion into said hole.

11. The invention of claim 8 and wherein the overall profile of said compliant pin is streamlined for fitting into said aperture.

* * * * *